US011661957B2

(12) United States Patent
Schmutzler

(10) Patent No.: US 11,661,957 B2
(45) Date of Patent: May 30, 2023

(54) DUAL DIRECTION VACUUM APPARATUS HAVING A VACUUM MODE AND PURGE MODE

(71) Applicant: Norgren Automation Solutions, LLC, Saline, MI (US)

(72) Inventor: Brandon Schmutzler, Cumberland, RI (US)

(73) Assignee: Norgren Automation Solutions, LLC, Saline, MI (US)

( * ) Notice: Subject to any disclaimer, the term of this patent is extended or adjusted under 35 U.S.C. 154(b) by 119 days.

(21) Appl. No.: 17/226,925

(22) Filed: Apr. 9, 2021

(65) Prior Publication Data

US 2022/0325725 A1 Oct. 13, 2022

(51) Int. Cl.

| | |
|---|---|
| ***F04F 5/46*** | (2006.01) |
| ***F04F 5/52*** | (2006.01) |
| ***F04F 5/20*** | (2006.01) |
| *F04F 5/16* | (2006.01) |

(52) U.S. Cl.

CPC ..... *F04F 5/464* (2013.01); *F04F 5/20* (2013.01); *F04F 5/52* (2013.01); *F04F 5/16* (2013.01); *F04F 5/461* (2013.01)

(58) Field of Classification Search

CPC ..... F04F 5/464; F04F 5/20; F04F 5/00; F04F 5/42

See application file for complete search history.

(56) References Cited

U.S. PATENT DOCUMENTS

| | | | | |
|---|---|---|---|---|
| 3,400,047 | A * | 9/1968 | Howard | F04F 5/34 976/DIG. 202 |
| 3,923,246 | A * | 12/1975 | Cloutier | F25C 3/04 239/14.2 |
| 5,032,059 | A * | 7/1991 | McCall | F04F 5/461 417/183 |
| 6,319,402 | B1 | 11/2001 | Schwandt et al. | |
| 7,886,727 | B2 | 2/2011 | Ulrey et al. | |
| 8,215,877 | B2 | 7/2012 | Rieger et al. | |
| 8,783,231 | B2 | 7/2014 | Leone | |

(Continued)

FOREIGN PATENT DOCUMENTS

EP 3 708 820 A1 9/2020

OTHER PUBLICATIONS

Search Report prepared by the United Kingdom Intellectual Property Office in application No. GB 2107410.9 dated Nov. 8, 2021.

*Primary Examiner* — Nathan C Zollinger
*Assistant Examiner* — Timothy P Solak
(74) *Attorney, Agent, or Firm* — McDonnell Boehnen Hulbert & Berghoff LLP

(57) ABSTRACT

A dual direction vacuum apparatus for creating vacuum and purging obstructions from a vacuum port of the apparatus. The apparatus provides a housing having an air passageway, wherein the air passageway has a first end and a second end. A vacuum pressure inlet is formed in the housing and is adaptable to receive pressurized air from a pressurized air source to create vacuum in the vacuum port and establish a vacuum mode. A purge pressure inlet is formed in the housing and adaptable to receive pressurized air from a pressurized air source to direct pressurized air toward the vacuum port to establish a purge mode and dislodge any obstructions from the vacuum port.

20 Claims, 3 Drawing Sheets

(56) References Cited

U.S. PATENT DOCUMENTS

| | | | | |
|---|---|---|---|---|
| 9,212,669 | B2 | 12/2015 | Krohn | |
| 10,309,425 | B1 * | 6/2019 | Burgess | F04F 5/46 |
| 10,724,550 | B2 | 7/2020 | Fletcher et al. | |
| 2020/0224946 | A1 | 7/2020 | Rosaen et al. | |

* cited by examiner

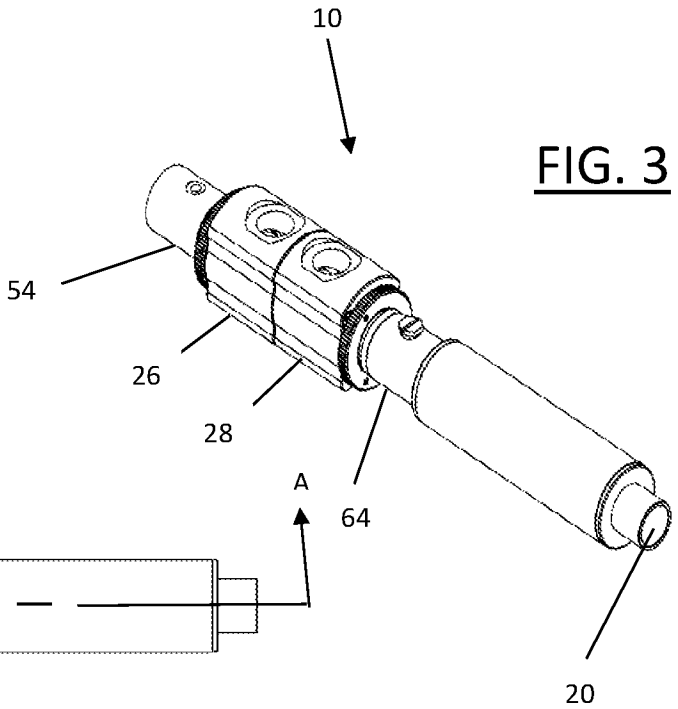
FIG. 3
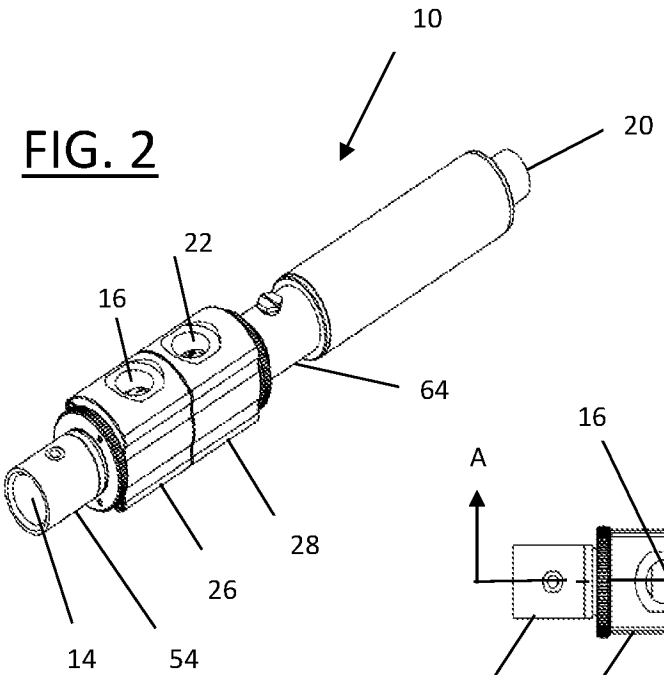
FIG. 2
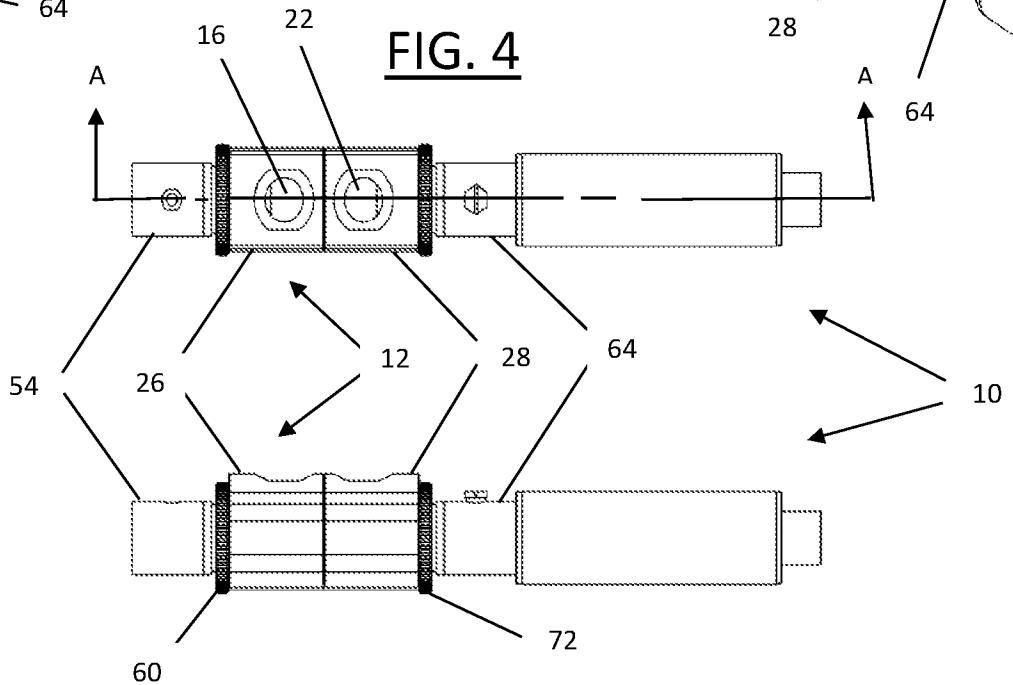
FIG. 4
FIG. 5

DUAL DIRECTION VACUUM APPARATUS HAVING A VACUUM MODE AND PURGE MODE

CROSS-REFERENCE TO RELATED APPLICATIONS

None.

TECHNICAL FIELD

The present disclosure relates to a vacuum generating apparatus, and more particularly, a variable flow venturi vacuum generator that directs the flow of pressurized air in one direction to create vacuum in a vacuum mode while also allowing pressurized air to be directed in an opposite direction in a purge mode, wherein pressurized air is directed through a vacuum port of the venturi vacuum generator to dislodge obstructions and debris that may form in the vacuum port.

BACKGROUND

Venturi devices are well known for creating vacuum in particular applications. One particular type of venturi device is a variable flow venturi vacuum generator that allows a user to adjust the level of vacuum created by the vacuum generator. Variable flow venturi vacuum generators may have a vacuum port and an exhaust path placed in line with one another to provide a straight-through venturi vacuum generator. Such venturi designs create high flow rates and vacuum levels, which allow such vacuum generators to be utilized in various commercial and industrial applications. For instance, such variable flow venturi vacuum generators have been utilized in extremely dirty and dusty environments, such as foundries and refractory and bagging operations.

The venturi jets within the variable flow venturi vacuum generators are typically not in line with the vacuum port and the exhaust path, and therefore, the variable flow venturi vacuum generators typically do not clog, lose suction, or require a vacuum filter. Nonetheless, due to the extremely dirty environments for which these devices are utilized, the vacuum port may become susceptible to obstructions and debris becoming lodged within the vacuum port. When this occurs, the vacuum level may drop thereby affecting the performance of the vacuum generator. To correct this situation, the supply of pressurized air to the variable flow venturi vacuum generator must be stopped, the vacuum generator must be shut down, and the obstruction or debris must be removed from the vacuum port. The debris is typically removed from the vacuum port manually which requires downtime and manual labor, thereby creating inefficiencies that are undesirable in an industrial environment. Others have attempted to blow pressurized air back through the exhaust port toward the vacuum port in attempt to dislodge the debris from the vacuum port, but due to the calibration and design of the variable flow venturi vacuum generators, directing pressurized air back through the exhaust port toward the vacuum port can degrade the performance of the vacuum generator while possibly damaging the internal mechanisms of the vacuum generator.

It would be desirable to provide a variable flow venturi vacuum generator that provides a mechanism for clearing obstructions from the vacuum port without the use of manual labor while limiting the amount of downtime, without affecting the calibration of the vacuum generator, and without damaging the internal mechanisms of the vacuum generator.

SUMMARY

The present disclosure provides a dual direction vacuum apparatus having a housing with an air passageway having a first end and a second end. A vacuum pressure inlet is formed in the housing and is adaptable to receive pressurized air from a pressurized air source. When in a vacuum mode, the vacuum pressure inlet is in communication with the air passageway, and pressurized air from the vacuum pressure inlet passes through a venturi jet and is directed toward the second end of the air passageway to create vacuum in the first end of the air passageway. A purge pressure inlet is formed in the housing and is adaptable to receive pressurized air from a pressurized air source. When in the purge mode, the purge pressure inlet is in communication with the air passageway, wherein pressurized air from the purge pressure inlet is directed toward the first end of the air passageway to dislodge obstructions or debris in the first end of the air passageway. The vacuum mode is defined as supplying pressurized air to the vacuum pressure inlet while not supplying pressurized air to the purge pressure inlet. The purge mode is defined as supplying pressurized air to the purge pressure inlet while not supplying pressurized air to the vacuum pressure inlet.

The housing may have an aperture extending there through, wherein the housing has a first end, a second end, and an hourglass shaped necking portion within the aperture. A vacuum nozzle is partially disposed in the aperture within the first end of the housing and has a tapered end that adjacently aligns with the necking portion of the housing to define the venturi jet and provide communication between the vacuum pressure inlet and the air passageway. A purge nozzle is partially disposed in the aperture within the second end of the housing and has a tapered end that adjacently aligns with the necking portion of the housing to provide communication between the purge pressure inlet and the air passageway.

The vacuum nozzle is adjustably positioned along a longitudinal axis of the aperture within the first end of the housing to adjustably control the amount of pressurized air passing through the venturi jet thereby adjusting the level of vacuum provided in the first end of the air passageway. The purge nozzle is adjustably positioned along a longitudinal axis of the aperture with the second end of the housing to adjustably control the amount of pressurized air passing through to the first end of the air passageway.

The vacuum nozzle threadably engages the aperture within the first end of the housing to adjustably position the vacuum nozzle along the longitudinal axis of the aperture within the housing. The purge nozzle threadably engages the aperture within the second end of the housing to adjustably position the purge nozzle along the longitudinal axis of the aperture with the housing.

A vacuum lock collar threadably engages the vacuum nozzle outside and adjacent the housing to secure the position of the vacuum nozzle relative to the housing. A purge lock collar threadably engages the purge nozzle outside and adjacent the housing to secure the position of the purge nozzle relative to the housing.

A collar has the aperture extending through a longitudinal axis of the collar and has the vacuum pressure inlet and the purge pressure inlet extending through a wall of the collar substantially perpendicular to the longitudinal axis of the aperture. A diffuser body with an hourglass shape is disposed within the aperture of the collar, and an aperture extending along the longitudinal axis of the diffuser body defines a portion of the air passageway. The collar may further include a vacuum collar having the vacuum pressure inlet formed therein, and a purge collar having the purge vacuum pressure inlet formed therein, wherein the vacuum collar is connected to the purge collar.

A vacuum sensor port is formed in the vacuum nozzle and is in communication with a vacuum sensor for monitoring the pressure within the first end of the air passageway. A purge sensor port is formed in the purge nozzle and is in communication with a purge sensor for monitoring the pressure within the second end of the air passageway. A controller may monitor the pressure indicated by the vacuum sensor and the purge sensor, wherein the controller engages and disengages the pressurized air provided to the vacuum pressure inlet and the purge pressure inlet based on the pressure indicated by the vacuum sensor and the purge sensor.

BRIEF DESCRIPTION OF THE FIGURES

The present disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

FIG. 2 is a right side isometric view showing the dual direction vacuum apparatus of the present disclosure;

FIG. 3 is a left side isometric view showing the dual direction vacuum apparatus of the present disclosure;

FIG. 4 is a top plan view showing the dual direction vacuum apparatus of the present disclosure;

FIG. 5 is a side plan view showing the dual direction vacuum apparatus of the present disclosure;

DETAILED DESCRIPTION

Figure 1:
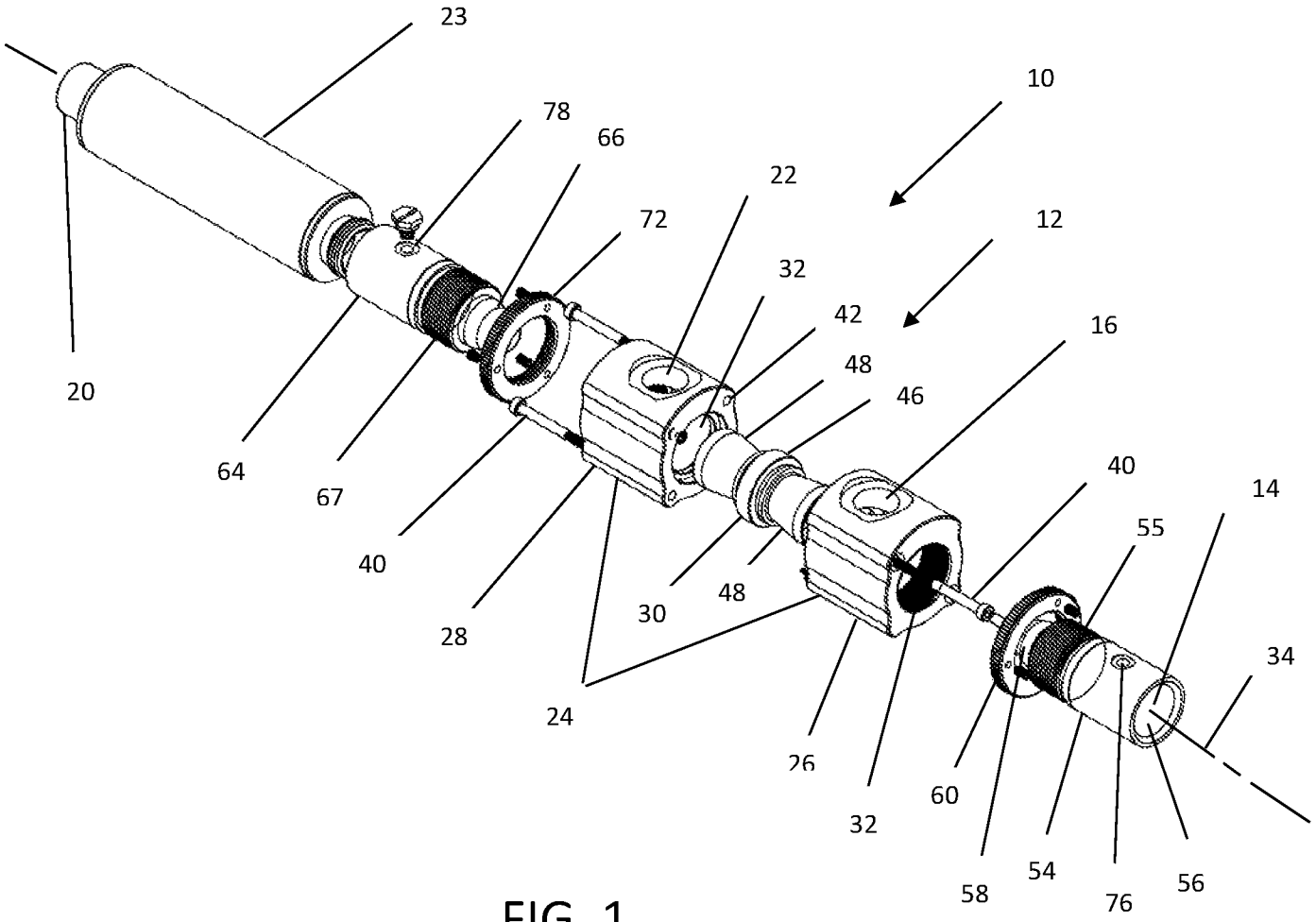
FIG. 1 is an exploded view of the dual direction vacuum apparatus of the present disclosure.
Figure 6:
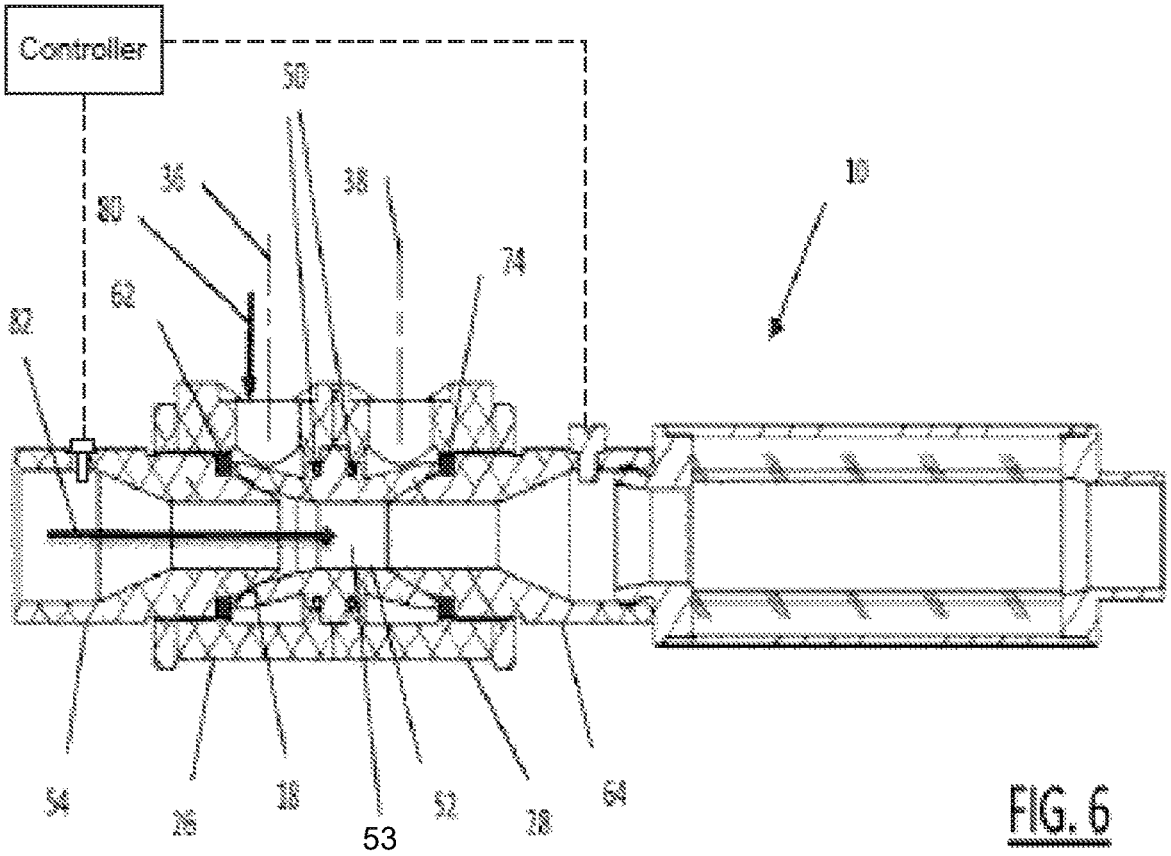
FIG. 6 is a cross-sectional view taken in the direction of arrows A-A in FIG. 4 showing the dual direction vacuum apparatus of the present disclosure in the vacuum mode.
Figure 7:
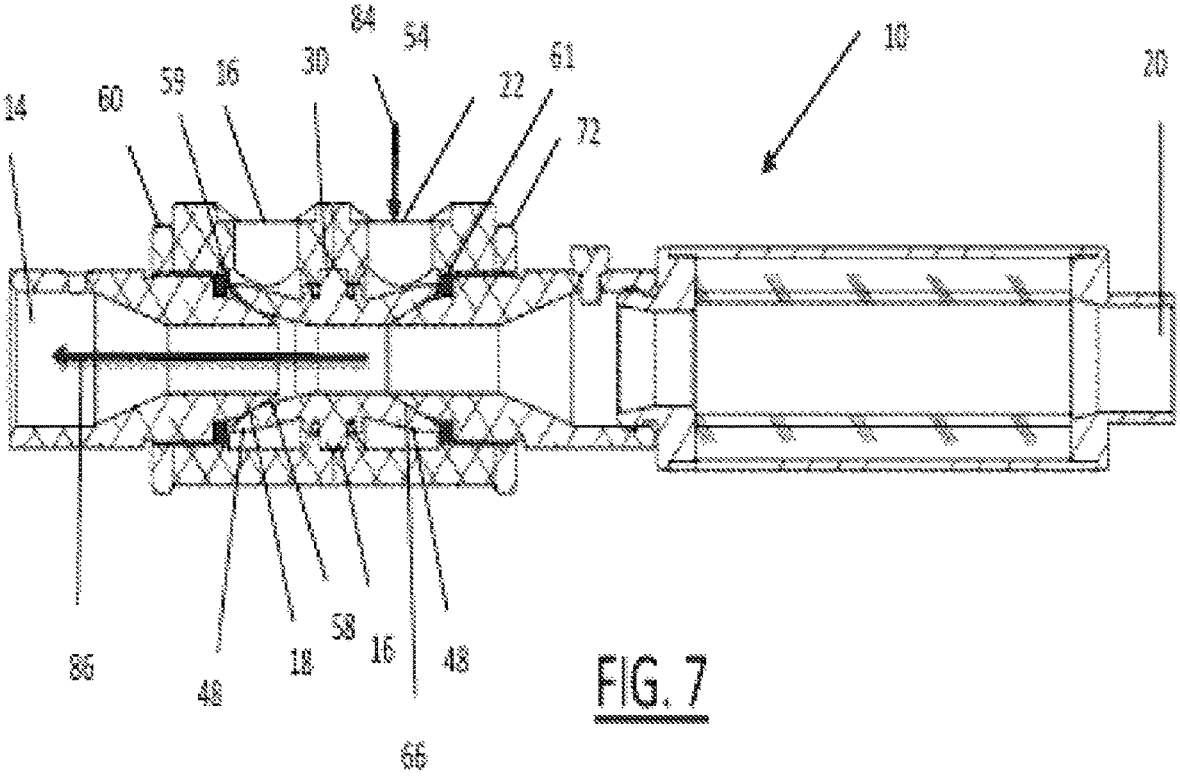
FIG. 7 is a cross-sectional view taken in the direction of arrows A-A in FIG. 4 showing the dual direction vacuum apparatus of the present disclosure in the purge mode

With reference to FIGS. 1-7, the present disclosure provides a dual direction vacuum apparatus 10 having a variable flow venturi vacuum generator 12 for creating vacuum at a vacuum port 14. The vacuum generator 12 may provide a vacuum pressure inlet 16 for receiving pressurized air from a pressurized air source (not shown), wherein the pressurized air passes through a venturi jet 18 to create vacuum in the vacuum port 14. The vacuum port 14 communicates and is in line with a purge port 20, wherein the pressurized air is exhausted through the purge port 20. The vacuum generator 12 may also provide a purge pressure inlet 22 for receiving pressurized air from the pressurized air source to direct pressurized air toward the vacuum port 14 to dislodge any obstructions or debris that may be lodged within the vacuum port 14. The vacuum generator 12 may operate in either a vacuum mode, wherein pressurized air passes through the venturi jet 18 to create vacuum in the vacuum port 14 and exhaust the pressurized air through the purge port 20 opposite the vacuum port 14, or a purge mode, wherein pressurized air is directed toward the vacuum port 14 to dislodge any obstructions or debris that may occur within the vacuum port 14. The vacuum port 14 may be connected to or in communication with any type of industrial tooling that may be utilized in conjunction with vacuum, such as tubing, hoses, vacuum cups, filters, vacuum tooling, etc. The purge port 20 may be connected to a silencer 23 or connected to or in communication with any type of tooling that may be utilized to properly exhaust pressurized air, such as tubing, hoses, filters, etc. The dual direction vacuum apparatus 10 is not limited to a variable flow venturi vacuum generator 12, but rather, the dual direction vacuum apparatus 10 may include any type of vacuum generating device that utilizes pressurized air to generate vacuum in the vacuum port 14 while using pressurized air to clear any obstructions or debris in the vacuum port 14.

The variable flow venturi vacuum generator 12 of the dual direction vacuum apparatus 10 may include a housing 24 having a vacuum collar 26, a purge collar 28, and a diffuser body 30. The vacuum collar 26 and the purge collar 28 have similar, substantially rectangular configurations with rounded sides and comers thereby creating a somewhat irregular outer configuration for complementarily engaging an industrial fixture (not shown). The outside configuration of the vacuum collar 26 and the purge collar 28 may assume various shapes for engaging industrial fixtures or tooling. Both the vacuum collar 26 and the purge collar 28 have an aperture 32 that extends through and along a longitudinal axis 34 of the vacuum collar 26 and the purge collar 28. The vacuum pressure inlet 16 provides an aperture extending through a side wall of the vacuum collar 26 and opening into the aperture 32 with a longitudinal axis 36 of the vacuum pressure inlet 16 substantially perpendicular to the longitudinal axis 34 of the aperture 32. The purge pressure inlet 22 similarly provides in aperture extending through a side wall of the purge collar 28 and opening into the aperture 32 with a longitudinal axis 38 of the purge pressure inlet 22 substantially perpendicular to the longitudinal axis 34 of the aperture 32. The vacuum collar 26 and the purge collar 28 may abut one another end to end while being connected by four fasteners 40 extending through four apertures 42 provided in the four comers of the vacuum collar 26 and the purge collar 28. By connecting the vacuum collar 26 to the purge collar 28, the vacuum pressure inlet 16 and the purge pressure inlet 22 remain in close proximity to one another. The present disclosure is not limited to the vacuum collar 26 and the purge collar 28 being separate structures, but rather, the vacuum collar 26 and the purge collar 28 may comprise an integral, one-piece structure. In addition, the diffuser body 30 may be formed integrally with the housing 24 or integrally formed with the vacuum collar 26 and the purge collar 28.

To direct the pressurized air from the vacuum pressure inlet 16 and the purge pressure inlet 22, the diffuser body 30 is disposed within the aperture 32 of the vacuum collar 26 and the purge collar 28. The diffuser body 30 has a substantially cylindrical, hourglass shaped configuration with an aperture 52 extending through and along the longitudinal axis 34 of the diffuser body 30. The aperture 52 in the diffuser body 30 defines a portion of an air passageway 53 extending through the vacuum generator 12 from the vacuum port 14 to the purge port 20, wherein a first end of the air passageway 53 is within the vacuum port 14, and a second end of the air passageway 53 is within the purge port 20. The diffuser body 30 includes a central cylindrical portion 46 having a pair of substantially similar conical end portions 48 extending from opposite ends of the central cylindrical portion 46. The central portion 46 has a stepped outer periphery that complementarily engages the inner periphery of the vacuum collar 26 and the purge collar 28 to seat and secure the diffuser body 30 within the vacuum collar 26 and the purge collar 28. The outer periphery of the central cylindrical portion 46 of the diffuser body 30 also provides a pair of annular grooves for receiving a pair of similar annular flexible seals 50 for preventing pressurized air from passing between the diffuser body 30 and the vacuum collar 26 and the purge collar 28. The conical end portions 48 of the diffuser body 30 extend and taper outward from opposite ends of the central cylindrical portion 46 of the diffuser body 30 such that the conical end portions 48 extend underneath and across the vacuum pressure inlet 16 and the purge pressure inlet 22 at an angle within the vacuum collar 26 and the purge collar 28.

To create vacuum within the vacuum generator 12, a vacuum nozzle 54 is received by a first or vacuum end of the aperture 32 provided in the vacuum collar 26. The vacuum nozzle 54 has a substantially cylindrical configuration that tapers narrowly toward a first end 58 of the vacuum nozzle 54. An aperture 56 extends through and along the longitudinal axis 34 of the vacuum nozzle 54 from the vacuum port 14 created at a second end of the vacuum nozzle 54 toward the tapered first end 58 of the vacuum nozzle 54. The vacuum nozzle 54 has a threaded portion 55 formed on an outer periphery of the mid portion of the vacuum nozzle 54, wherein the threaded portion 55 of the vacuum nozzle 54 threadably engages a threaded portion formed on an inner periphery of the vacuum collar 26 defining the aperture 32. The threaded engagement of the vacuum collar 26 and the vacuum nozzle 54 allows the vacuum nozzle 54 to be adjustably positioned along the longitudinal axis 34 of the vacuum collar 26. A cylindrical vacuum lock collar 60 may be threadably connected to the threaded portion of the vacuum nozzle 54 and threadably tightened against the vacuum collar 26 to secure and hold the vacuum nozzle 54 in a desired position. A flexible annular seal 62 is position between the vacuum nozzle 54 and the vacuum collar 26 between the threaded portion 55 and the tapered end 58 of the vacuum nozzle 54. The flexible annular seal 62 prohibits pressurized air from passing between the vacuum nozzle 54 and the vacuum collar 26.

In order to form the venturi jet 18 within the vacuum generator 12, the tapered end 58 of the vacuum nozzle 54 is adjacently aligned with one conical end portion 48 of the diffuser body 30. The outer periphery of the tapered end 58 of the vacuum nozzle 54 and the inner periphery of the conical end portion 48 of the diffuser body 30 are complementarily shaped to form an hourglass shaped vacuum passageway 59 that extends between the vacuum pressure inlet 16 and the air passageway 53. The hourglass shaped vacuum passageway 59 provides a narrowing portion extending between larger portions at each end of the narrowing portion thereby establishing the venturi jet 18. As pressurized air is supplied to the vacuum pressure inlet 16, as shown by arrow 80 in FIG. 6, the pressure level of the pressurized air builds in the vacuum passageway 59 prior to the narrowing potion of the vacuum passageway 59. The speed at which the pressurized air is traveling accelerates as the pressurized air passes through the narrowing portion in the vacuum passageway 59. As the high speed pressurized air passes through the vacuum passageway 59 and into the air passageway 53 of the diffuser body 30, air is drawn into the air passageway 53 from the vacuum port 14 thereby reducing the air pressure and creating vacuum in the vacuum port 14 of the vacuum nozzle 54, as shown by arrow 82 in FIG. 6. The size or width of the vacuum passageway 59 may be adjusted by threadably adjusting the vacuum nozzle 54 along the longitudinal axis 38 of the aperture 32. By increasing the size or width of the vacuum passageway 59, the vacuum level in the vacuum port 14 may be reduced, and by decreasing the size or width of the vacuum passageway 59, the vacuum level within the vacuum port 14 may be increased.

To provide pressurized air to the vacuum port 14, a purge nozzle 64 is received by a second or purge end of the aperture 32 provided in the purge collar 28, similar to the vacuum nozzle 54 provided in the aperture 32 of the vacuum collar 26. That is, the purge nozzle 64 has a substantially cylindrical configuration that tapers narrowly toward a first end 66 of the purge nozzle 64. An aperture 56 extends through and along the longitudinal axis 38 of the purge nozzle 64 from the purge port 20 created at a second end of the purge nozzle 64 toward the tapered first end 66 of the purge nozzle 64. The purge nozzle 64 has a threaded portion 67 formed on an outer periphery of the mid portion of the purge nozzle 64, wherein the threaded portion 67 of the purge nozzle 64 threadably engages a threaded portion formed on an inner periphery of the purge collar 28 defining the aperture 32. The threaded engagement of the purge collar 28 and the purge nozzle 64 allows the purge nozzle 64 to be adjustably positioned along the longitudinal axis 38 of the purge collar 28. A cylindrical purge lock collar 72 is threadably connected to the threaded portion 67 of the purge nozzle 64 and may be threadably tightened against the purge collar 28 to secure and hold the purge nozzle 64 in a desired position. A flexible annular seal 74 is position between the purge nozzle 64 and the purge collar 28 between the threaded portion 67 and the tapered end 66 of the purge nozzle 64. The flexible annular seal 74 prohibits pressurized air from passing between the purge nozzle 64 and the purge collar 28.

In order to accelerate the pressurized air from the purge pressure inlet 22 to the vacuum port 14, the tapered end 66 of the purge nozzle 64 is adjacently aligned with one conical end portion 48 of the diffuser body 30. The outer periphery of the tapered end 66 of the purge nozzle 64 and the inner periphery of the conical end portion 48 of the diffuser body 30 are complementarily shaped to form an hourglass shaped purge passageway 61 that extends between the purge pressure inlet 22 and the air passageway 53. The hourglass shaped purge passageway 61 provides a narrowing portion extending between larger portions at each end of the narrowing portion of the purge passageway 61. As pressurized air is supplied to the purge pressure inlet 22, as shown by arrow 84 in FIG. 7, the pressure level of the pressurized air builds in the purge passageway 61 prior to the narrowing portion in the purge passageway 61. The speed at which the pressurized air is traveling accelerates as the pressurized air passes through the narrowing portion in the purge passageway 61. As the high speed pressurized air passes through the narrowing portion of the purge passageway 61 into the air passageway 53 of the diffuser body 30, the pressurized air is directed toward the vacuum port 14, as shown by the arrow in FIG. 7, thereby establishing the purge mode. Due to the angle of the purge passageway 61 and the close proximity to the vacuum passageway 59, the pressurized air is primarily directed through the air passageway 53 and not the vacuum passageway 59, thereby avoiding the pressurized air from affecting the venturi jet 18 in the vacuum passageway 59. The size or width of the purge passageway 61 may be adjusted by threadably adjusting the purge nozzle 64 along the longitudinal axis 38 of the aperture 32. By increasing the size or width of the purge passageway 61, the level of pressurized air directed to the vacuum port 14 may be reduced, and by decreasing the size or width of the purge passageway 61, the level of pressurized air to the vacuum port 14 may be increased.

To change the apparatus 10 between the vacuum mode and the purge mode, a vacuum sensor may be utilized to monitor the vacuum level within the vacuum port 14, and a purge sensor may be utilized to monitor the pressurized level within the purge port 20. The vacuum sensor is mounted within a vacuum sensor port 76 formed by an aperture that extends through a wall of the vacuum nozzle 54 in order to monitor the level of vacuum in the vacuum nozzle 54. The purge sensor is similarly mounted within a purge sensor port 78 formed by an aperture that extends through a wall of the purge nozzle 64 in order to monitor the level of pressurized air in the purge port 20. A controller is in electronic communication with the vacuum sensor and the purge sensor. When the controller determines that the pressure levels measured by the vacuum sensor and/or the purge sensor are within a specified range for operating the apparatus 10 in the vacuum mode, the controller maintains the apparatus 10 in the vacuum mode. When the controller determines that the pressure levels measured by the vacuum sensor and/or the purge sensor are outside of the normal operating range, the controller may shut down the pressurized air to the vacuum pressure inlet 16 and engage pressurized air to the purge pressure inlet 22 to remove any obstructions or debris that may be lodged in the vacuum port 14. Once the obstruction or debris is removed from the vacuum port 14, the controller may return the apparatus 10 to the vacuum mode. In the alternative, the controller may simply provide a warning when the vacuum sensor and/or the purge sensor are out of the normal performance range. When this occurs, an operator may manually disengage pressurized air to the vacuum pressure inlet 16 while engaging pressurized air to the purge pressure inlet 22 to remove any obstructions or debris that may be lodged in the vacuum port 14.

In operation, the apparatus 10 normally operates in the vacuum mode. That is, pressurized air is supplied to the vacuum pressure inlet 16, as shown by arrow 80 in FIG. 6, and pressurized air is not supplied to the purge pressure inlet 22. By supplying pressurized air to the vacuum pressure inlet 16, vacuum is generated in the vacuum port 14 by pressurized air passing through the venturi jet 18 provided in the vacuum passageway 59 and into the air passageway 53, as shown by arrow 82 in FIG. 6, thereby establishing the vacuum mode. If an obstruction or debris becomes lodged within the vacuum port 14, the vacuum sensor and the purge sensor will indicate that the operating pressure levels are outside of the normal operating specifications, and thus, the controller will indicate the same. At that time, the controller may automatically, or a user may manually, disengage the pressurized air from the vacuum pressure inlet 16 and engage the pressurized air to the purge pressure inlet 22, as shown by arrow 84 in FIG. 7, so as to establish the purge mode. This will allow pressurized air to flow through the purge passageway 61 toward the vacuum port 14, as shown by arrow 86 in FIG. 7, thereby dislodging the obstruction or debris lodged within the vacuum port 14. Once the obstruction or debris is dislodged from the vacuum port 14, the pressurized air to the purge pressure inlet 22 may be disengaged, and the pressurized air to the vacuum pressure inlet 16 may be reengaged so that vacuum may return to the vacuum port 14 thereby reestablishing the vacuum mode. The cycle may then repeat itself.

While the disclosure has been made in connection with what is presently considered to be the most practical and preferred embodiment, it should be understood that the disclosure is intended to cover various modifications and equivalent arrangements.

What is claimed is:

1. A dual direction vacuum apparatus, comprising:

a housing having an air passageway, wherein the air passageway has a first end and a second end, wherein the housing has an aperture extending therethrough;

a vacuum pressure inlet formed in the housing and adaptable to receive pressurized air from a pressurized air source, the vacuum pressure inlet in communication with the air passageway;

a vacuum nozzle partially disposed in the aperture within the housing, such that a venturi jet is defined between the vacuum nozzle and the housing, wherein pressurized air from the vacuum pressure inlet passes through the venturi jet and is directed toward the second end of the air passageway to create a vacuum in the first end of the air passageway when the apparatus is in a vacuum mode;

a purge pressure inlet formed in the housing and adaptable to receive pressurized air from a pressurized air source, the purge pressure inlet in communication with the air passageway; and a purge nozzle partially disposed in the aperture within the housing, such that the purge nozzle provides communication between the purge pressure inlet and the air passageway, wherein pressurized air from the purge pressure inlet is directed toward the first end of the air passageway to dislodge obstructions in the first end of the air passageway when the apparatus is in a purge mode.

2. The dual direction vacuum apparatus as stated in claim 1, further comprising:

the vacuum mode defined as supplying pressurized air to the vacuum pressure inlet while not supplying pressurized air to the purge pressure inlet; and the purge mode defined as supplying pressurized air to the purge pressure inlet while not supplying pressurized air to the vacuum pressure inlet.

3. The dual direction vacuum apparatus as stated in claim 2, wherein:

the housing has a necking portion shaped as an hour glass within the aperture, the vacuum nozzle has a tapered end that adjacently aligns with the necking portion of the housing to define the venturi jet and provide communication between the vacuum pressure inlet and the air passageway, and the purge nozzle has a tapered end that adjacently aligns with the necking portion of the housing to provide the communication between the purge pressure inlet and the air passageway.

4. The dual direction vacuum apparatus as stated in claim 3, further comprising:

the vacuum nozzle adjustably positioned along a longitudinal axis of the aperture within the housing to adjustably control the amount of pressurized air passing through the venturi jet thereby adjusting the level of vacuum provided in the first end of the air passageway; and the purge nozzle adjustably positioned along the longitudinal axis of the aperture within the housing to adjustably control the amount of pressurized air passing through to the first end of the air passageway.

5. The dual direction vacuum apparatus as stated in claim 4, further comprising:

the vacuum nozzle threadably engaging the aperture within the housing to adjustably position the vacuum nozzle along the longitudinal axis of the aperture within the housing; and the purge nozzle threadably engaging the aperture within the housing to adjustably position the purge nozzle along the longitudinal axis of the aperture within the housing.

6. The dual direction vacuum apparatus as stated in claim 5, further comprising:

a vacuum lock collar threadably engaging the vacuum nozzle outside and adjacent the housing to secure the position of the vacuum nozzle relative to the housing; and a purge lock collar threadably engaging the purge nozzle outside and adjacent the housing to secure the position of the purge nozzle relative to the housing.

7. The dual direction vacuum apparatus as stated in claim 3, wherein the housing further comprises:

a collar having the aperture extending through a longitudinal axis of the collar and having the vacuum pressure inlet and the purge pressure inlet extending through a wall of the collar substantially perpendicular to the longitudinal axis of the collar; and a diffuser body having an hourglass shape disposed within the aperture, and an aperture extending through a longitudinal axis of the diffuser body defining a portion of the air passageway.

8. The dual direction vacuum apparatus as stated in claim 7, wherein the collar further comprises:

a vacuum collar having the vacuum pressure inlet formed therein; and a purge collar having the purge pressure inlet formed therein, wherein the vacuum collar is connected to the purge collar.

9. The dual direction vacuum apparatus as stated in claim 3, further comprising:

a vacuum sensor port formed in the vacuum nozzle and in communication with a vacuum sensor for monitoring the pressure within the first end of the air passageway; and a purge sensor port formed in the purge nozzle and in communication with a purge sensor for monitoring the pressure within the second end of the air passageway.

10. The dual direction vacuum apparatus as stated in claim 9, further comprising:

a controller for monitoring the pressure indicated by the vacuum sensor and the purge sensor, wherein the controller engages and disengages the pressurized air provided to the vacuum pressure inlet and the purge pressure inlet based on the pressure indicated by the vacuum sensor and the purge sensor.

11. A dual direction vacuum apparatus, comprising:

a housing having an aperture extending therethrough with a first end and a second end, and an air passageway extending through and along a longitudinal axis of the housing, wherein the aperture has an hour glass shaped necking portion defining a portion of the air passageway;

a vacuum nozzle having a tapering first end disposed within the first end of the aperture in the housing, wherein the tapering first end is adjacently positioned in the hour glass shaped necking portion of the air passageway within the housing to form a venturi jet between the tapering first end of the vacuum nozzle and the hour glass shaped necking portion of the housing, and the vacuum nozzle having an air passageway extending through the vacuum nozzle and in communication with the air passageway of the housing;

a purge nozzle having a tapering first end disposed within the second end of the aperture of the housing and adjacently positioned in the hour glass shaped necking portion of the aperture within the housing to form a purge passageway between the tapering first end of the purge nozzle and the hour glass shaped necking portion of the housing, and the purge nozzle having an air passageway extending through the purge nozzle and in communication with the air passageway of the housing and the vacuum nozzle;

a vacuum pressure inlet formed in the housing and adaptable to receive pressurized air from a pressurized air source, wherein the vacuum pressure inlet communicates pressurized air from the pressurized air source to the venturi jet, wherein a vacuum is created in the air passageway of the vacuum nozzle when pressurized air passes through the venturi jet and into the air passageway of the housing and the purge nozzle; and a purge pressure inlet formed in the housing and adaptable to receive pressurized air from a pressurized air source, wherein the purge pressure inlet communicates pressurized air from the pressurized air source to the purge passageway and through the air passageway of the vacuum nozzle to dislodge obstructions in the air passageway of the vacuum nozzle.

12. A dual direction vacuum apparatus, as stated in claim 11, further comprising:

a vacuum mode wherein pressurized air is supplied to the vacuum pressure inlet but not to the purge pressure inlet; and a purge mode wherein pressurized air is supplied to the purge pressure inlet but not to the vacuum pressure inlet.

13. A dual direction vacuum apparatus, as stated in claim 12, further comprising:

the vacuum nozzle adjustably positioned within the housing along a longitudinal axis of the aperture to adjustably control the amount of pressurized air passing through the venturi jet thereby adjusting the level of vacuum provided in the air passageway of the vacuum nozzle; and the purge nozzle adjustably positioned within the housing along the longitudinal axis of the aperture to adjustably control the amount of pressurized air passing through to the air passageway of the vacuum nozzle.

14. The dual direction vacuum apparatus as stated in claim 13, further comprising:

the vacuum nozzle threadably engaging the aperture within the housing to adjustably position the vacuum nozzle within the housing along the longitudinal axis of the aperture; and the purge nozzle threadably engaging the aperture within the housing to adjustably position the purge nozzle within the housing along the longitudinal axis of the aperture.

15. The dual direction vacuum apparatus as stated in claim 14, further comprising:

a vacuum lock collar threadably engaging the vacuum nozzle outside and adjacent the housing to secure the position of the vacuum nozzle relative to the housing; and a purge lock collar threadably engaging the purge nozzle outside and adjacent the housing to secure the position of the purge nozzle relative to the housing.

16. The dual direction vacuum apparatus as stated in claim 15, wherein the housing further comprises:

a collar having the aperture extending through a longitudinal axis of the collar and having the vacuum pressure inlet and the purge pressure inlet extending through a wall of the collar substantially perpendicular to the longitudinal axis of the collar; and a diffuser body having an hourglass shape disposed within the aperture, and an aperture extending through a longitudinal axis of the diffuser body defining a portion of the air passageway.

17. The dual direction vacuum apparatus as stated in claim 16, wherein the collar further comprises:

a vacuum collar having the vacuum pressure inlet formed therein; and a purge collar having the purge vacuum pressure inlet formed there, wherein the vacuum collar is connected to the purge collar.

18. The dual direction vacuum apparatus as stated in claim 12, further comprising:

a vacuum sensor port formed in the vacuum nozzle and in communication with a vacuum sensor for monitoring the pressure within the air passageway of the vacuum nozzle; and a purge sensor port formed in the purge nozzle and in communication with a purge sensor for monitoring the pressure within the air passageway of the purge nozzle.

19. The dual direction vacuum apparatus as stated in claim 18, further comprising:

a controller for monitoring the pressure indicated by the vacuum sensor and the purge sensor, wherein the controller engages and disengages the pressurized air provided to the vacuum pressure inlet and the purge pressure inlet based on the pressure indicated by the vacuum sensor and the purge sensor.

20. A dual direction vacuum apparatus, comprising:

a housing having an aperture extending therethrough with a first end and a second end, and an air passageway extending through and along a longitudinal axis of the housing, wherein the housing has an hour glass shaped necking portion defining a portion of the air passageway;

a vacuum nozzle having a tapered first end disposed within the first end of the aperture in the housing, wherein the tapering first end is adjustably positioned adjacent the hour glass shaped necking portion of the of the housing to form a venturi jet, and the vacuum nozzle having an air passageway extending through the vacuum nozzle and in communication with the air passageway of the housing;

a purge nozzle having a tapering first end disposed within the second end of the aperture of the housing and adjustably positioned adjacent the hour glass shaped necking portion of the housing to form a purge passageway, and the purge nozzle having an air passageway extending through the purge nozzle and in communication with the air passageway of the housing;

a vacuum pressure inlet formed in the housing and adaptable to receive pressurized air from a pressurized air source, wherein the vacuum pressure inlet provides a passageway for communicating pressurized air from the pressurized air source to the venturi jet, wherein a vacuum is created in the air passageway of the vacuum nozzle when pressurized air passes through the venturi jet and into the air passageway of the housing and the purge nozzle thereby establishing a vacuum mode;

a purge pressure inlet formed in the housing and adaptable to receive pressurized air from a pressurized air source, wherein the purge pressure inlet provides a passageway for communicating pressurized air from the pressurized air source to the purge passageway, wherein pressurized air is directed through the air passageway of the vacuum nozzle to dislodge obstructions in the air passageway of the vacuum nozzle thereby establishing a purge mode;

a vacuum sensor for monitoring the pressure within the air passageway of the vacuum nozzle;

a purge sensor for monitoring the pressure within the air passageway of the purge nozzle; and a controller for monitoring the vacuum sensor and the purge sensor and indicating whether the apparatus should be in the vacuum mode or the purge mode.

* * * * *